United States Patent [19]

Naumann

[11] Patent Number: 5,072,602

[45] Date of Patent: Dec. 17, 1991

[54] WEFT THREAD TRANSPORTER

[75] Inventor: Rolf Naumann, Muhleim/Mein, Fed. Rep. of Germany

[73] Assignee: Karl Mayer Textilmaschinenfabrik GmbH, Fed. Rep. of Germany

[21] Appl. No.: 451,758

[22] Filed: Dec. 18, 1989

[30] Foreign Application Priority Data

Dec. 20, 1988 [DE] Fed. Rep. of Germany ..... 3842870

[51] Int. Cl.[5] ..... D04B 23/00

[52] U.S. Cl. ..... 66/84 A; 66/125 R; 66/146

[58] Field of Search ..... 66/84 R, 84 A, 125 R, 66/146

[56] References Cited

U.S. PATENT DOCUMENTS 4,487,039 12/1984 Mayer ..... 66/84 A

FOREIGN PATENT DOCUMENTS 2073261 10/1981 United Kingdom ..... 66/125 R

*Primary Examiner*—Werner H. Schroeder
*Assistant Examiner*—John J. Calvert
*Attorney, Agent, or Firm*—Omri M. Behr

[57] ABSTRACT

The arrangement provides warp threads for an oscillating weft thread magazine for warp knitting machine. The machine uses a creel, a first delivery device with constant delivery speed, and a second delivery device with a variable thread drive speed. The latter speed corresponds to the instantaneous take-off speed of the weft thread by the carriage. A storage arrangement is located between the two delivery devices for smoothing out the differences between the constant delivery speed and the variable take-off speed. This arrangement enables use of elastic weft threads on the weft thread magazine, so that they are provided in a state of constant tension stage; in particular, tension-free or very slightly tensioned.

21 Claims, 4 Drawing Sheets

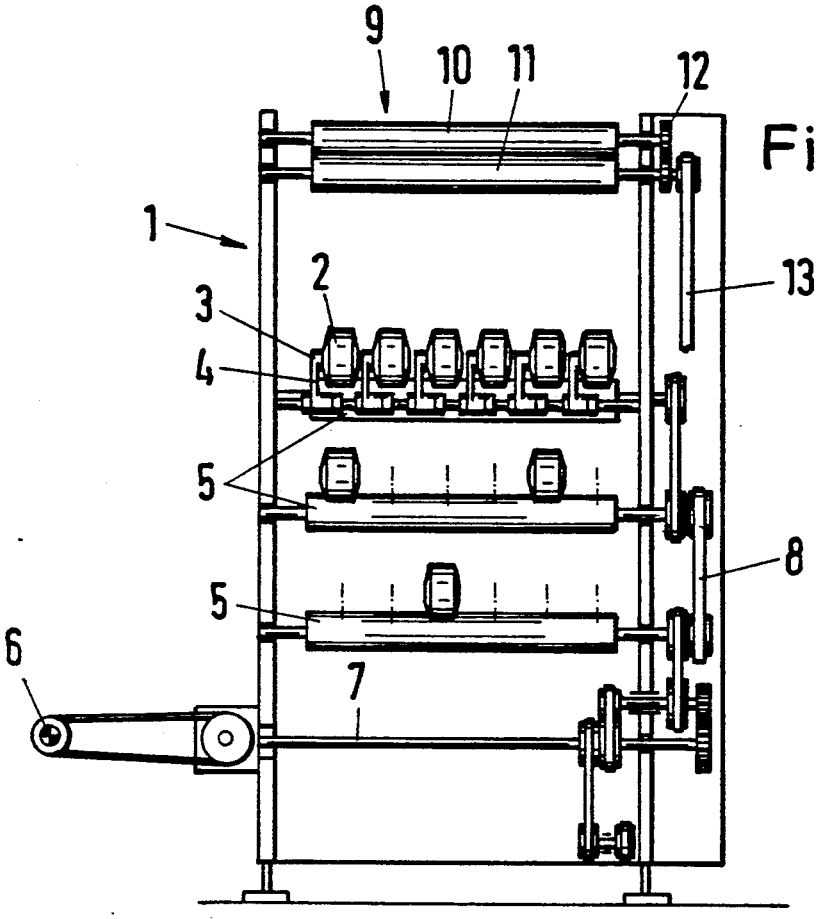
Fig. 2
Fig. 3
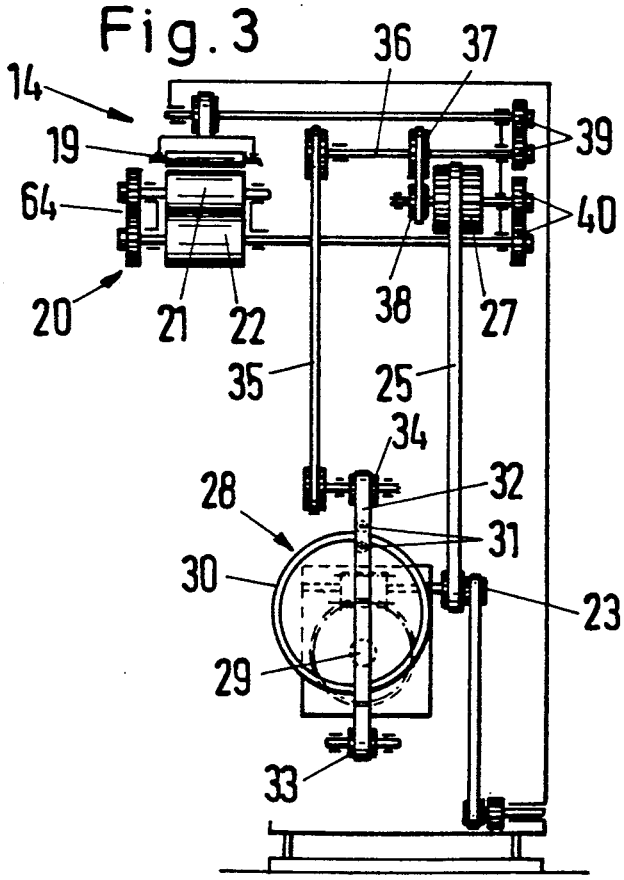
Fig. 4
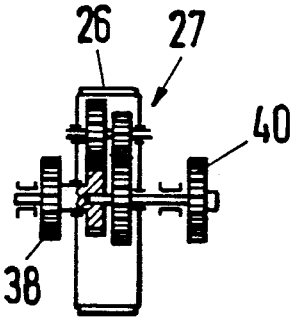

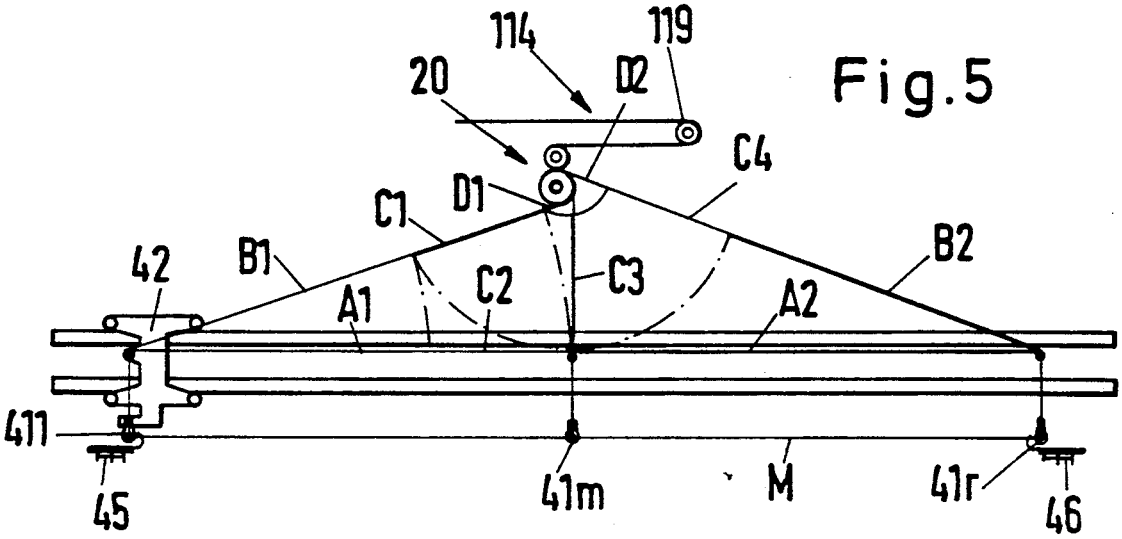
Fig.5
Fig.6
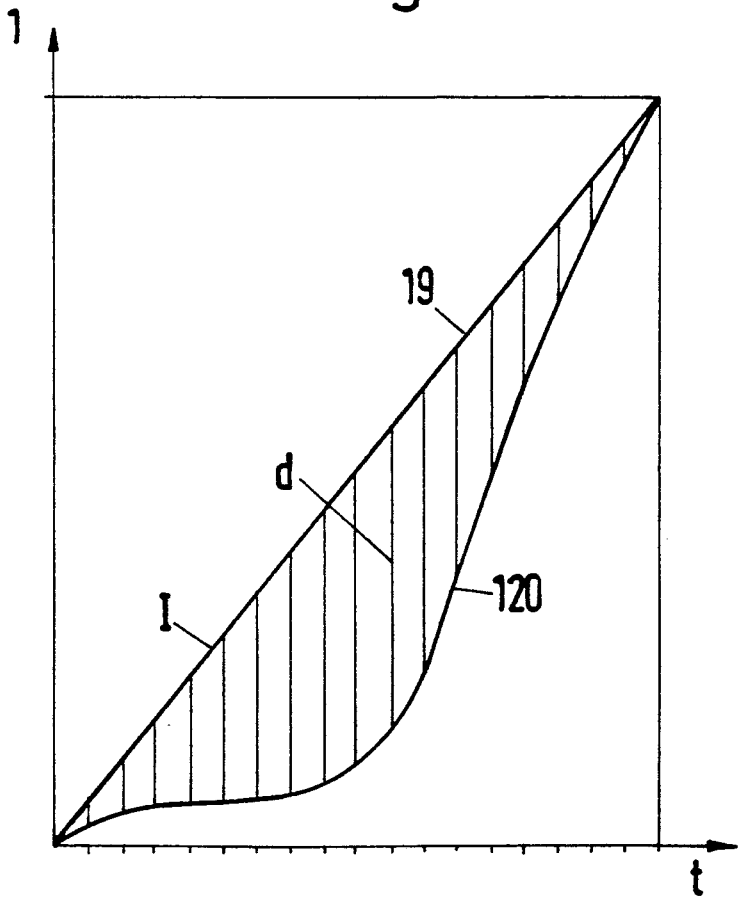

WEFT THREAD TRANSPORTER

BACKGROUND OF THE INVENTION

The present invention concerns an arrangement for providing weft thread for a continuous oscillating weft thread magazine of a warp knitting machine. The machine works with a creel and with a delivery means, which delivers the weft thread with constant delivery speed. This machine can include a carriage with thread guides that take the thread from a take-off point at a take-off speed corresponding to its respective position from one carrier chain of the magazine to the other and back again. The invention also relates to a storage arrangement upstream of the take-off point for compensating for the difference between the constant delivery speed and the variable take-off speed. The apparatus can work with working elastic weft threads.

A weft thread provision arrangement of this general type is known in the expander creel for the weft lock machine (type ExWe), manufactured by Liba. The spools in the creel carry elastic weft threads and are friction driven circumferentially. The delivery means forwards these threads at the means consumption speed. The delivery point which is formed by a reversing roller, is located above and approximately in the middle of the travel path of the carriage. The back and forth movement of the carriage, the sinusoidal speed and the delay time at the path ends to lay the threads about the hooks of the carrier chains, lead to a thread consumption varying considerably with time and thus, to a variable take-off speed at the take-off point. The storage arrangement to neutralize the difference between the constant delivery speed and the variable take-off speed comprises a cam controlled lever with two reversing idlers displaced in the direction of the axis of the levers, which work with three location fixed reversing idlers. The storage arrangement takes up thread material during the movement of the carriage from one carrier chain up to the midpoint and redelivers this during the second half of the travel of the carriage.

The problem posed for solution by the invention lies therein that there be provided a weft thread provision arrangement of the forgoing type wherein it is possible to deliver weft threads with constant tension values, in particular tension-free or substantially untensioned to the reversing weft thread magazine, which property is particularly valuable for elastic weft threads.

SUMMARY OF THE INVENTION

In accordance with the illustrative embodiments demonstrating features and advantages of the present invention, there is provided a weft thread transporter for a continuous, oscillating weft magazine in a warp knitting machine driven by a main shaft. This machine has a pair of parallel weft carriers and consumes weft threads from a creel. The transporter is adapted to work with the weft threads when they are either elastic or non-elastic. The transporter has a carriage with thread guides for laying the weft threads across the parallel weft carriers with a cyclically varying laying speed depending upon the position of the carriage. The carriage can lay the weft threads by reciprocating between the parallel weft carriers of the magazine. The transporter has a first and second delivery means. The first delivery means can provide the weft threads from the creel at a substantially constant delivery speed. The second delivery means is downstream from the first delivery means and can deliver therefrom the weft threads at a variable thread drive speed that corresponds to the cyclically varying laying speed. The transporter also has a storage means located between the first and second delivery means for compensating for the difference between the constant delivery speed and the variable thread drive speed.

By employing apparatus of the foregoing type thread can be delivered with substantially constant tension. To this end, the take-off point is formed by a second delivery means whose thread drive speed is preferably variable and corresponds to the take-off speed at a particular time point.

The provision of the second delivery means ensures that on the take-off side, continuously, only that amount of thread length is delivered, as the carriage actually requires or at least a thread length proportional thereto. Unacceptable tension peaks are thus avoided. The weft threads keep the same tension which they had at the first delivery means and maintain it until they reach the reversing weft thread magazine. In this way, it is possible to operate with tension-free or substantially tensionless weft threads in knitted goods, so that after completion of the knitting process, these goods either do not crimp or crimp in a totally uniform manner.

Preferably, the thread drive speed is set to be equivalent to the delivery speed at a given moment. This leads to a tension-free laying of the weft threads.

In a particular embodiment, a second delivery means has its own drive motor which is controlled by means of a computer based upon the position of the carriage. This is one simple manner to obtain the variable thread drive speed.

In another possible embodiment, the second drive means is driven by the main shaft of the knitting machine via an interference drive whose interference input is oscillated by a reciprocating drive arrangement by an amount corresponding to the position of the carriage. In this mode, the thread drive speed is taken off mechanically from the rotation of the main shaft.

It is particularly desirable to provide that the storage means has only one deflecting point which is oscillated by a reciprocating drive arrangement in proportion to the difference between the drive speeds of both of the delivery means. Thus, since only one moveable deflecting point is available, the friction forces operating upon the weft threads are substantially reduced.

In particular, the interference input and the storage means may be driven by the same reciprocating drive means. This simplifies the construction.

It is particularly advantageous if the reciprocating drive means has a stroke drive which comprises a cam drivable by the main shaft of the knitting machine. The cam reciprocates an output element, and is an efficient way of getting a reciprocating drive from the main shaft.

It is advantageous if the deflecting point of the storage means reciprocates on a straight path. If the weft threads are lead to and taken off, from a straight path in a parallel manner, the storage arrangement can operate at its greatest capacity.

In an especially preferred mode, the deflecting point is carried by a carriage which is reciprocatable by means of an endless belt by the reciprocating arrangement. In particular, an endless belt acting as a timing belt can interact with a driven timing belt pulley.

In order to reduce breaking friction to a minimum, the deflecting point of the storage means can be formed by a roller driven at varying speeds. For example, a pinion attached to the carriage can interact with a rack which runs along a straight path. The pinion's drive shaft may be coupled to the shaft of a deflecting roller through two drive branches, each able to free wheel, one able to reverse the direction of rotation. Thus, the deflecting roller can be driven in the desired direction independently of the movement direction of the carriage.

This construction may be achieved in that one drive branch has two spaced gears and the other drive branch with two timing belt pulleys. One drive branch causes a deceleration and the other, an acceleration.

In one alternative, the deflecting roller has its own drive motor which is controlled by a computer. In another alternative, the deflecting point of the storage means is formed by a deflecting roller running drive-free in frictionless bearings. There is also the possibility that the deflecting point of the storage means is formed by a non-rotating round rod with a friction-free upper surface. In all of these cases the braking friction on the weft thread is held to a minimum.

The utilization of the second delivery means permits the first delivery means to be but a single driven roller.

In a further modification, the proportioning of the drive speeds of the second delivery means, the first delivery means, the storage means and the spools relative to each other is achieved by a geared transmission. The use of such gearing permits the achievement of desired tensions without the need to change the basic drive of the storage means in any way.

BRIEF DESCRIPTION OF THE DRAWINGS

The invention is illustrated, with respect to its preferred embodiments, by the following figures:

FIG. 2 is a side elevational view of the apparatus of FIG. 1, viewed from direction A.

FIG. 3 is a side elevational view of the drive arrangement of FIG. 1, viewed along lines B—B.

FIG. 4 is cross-sectional view of the interference drive illustrated in FIG. 3.

FIG. 5 is a schematic representation of the thread laying process.

FIG. 6 is a graphical representation showing a plot of thread consumption against time in the thread laying process.

DETAILED DESCRIPTION OF THE PREFERRED EMBODIMENT

Figure 1:
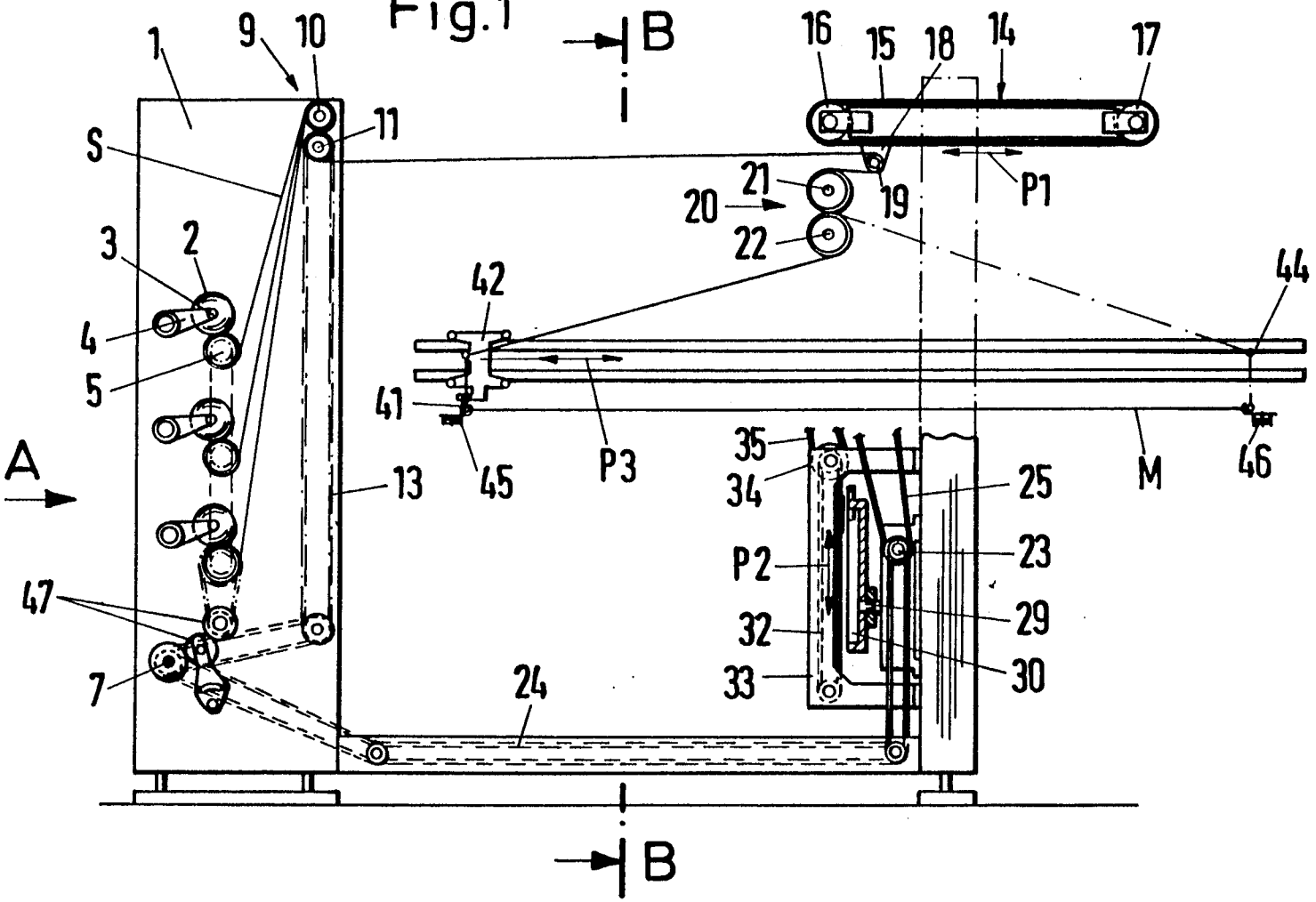
FIG. 1 is a schematic, partial, front elevational view of the weft thread provision arrangement.

Referring to FIGS. 1-3, creel 1 has a plurality of spools 2 supported on pegs 3, which rest on rocking levers 4. Their weight and the influence of springs (not shown) causes them to rest with their circumferences on driving friction rollers 5. These are driven by the main shaft 6 of the corresponding warp knitting machine over an intermediate shaft 7 and other drive elements 8. A first delivery means 9 comprises two rollers 10 and 11, which are coupled with each other by means of a pair of gear wheels 12. These are driven by the main shaft 6 over intermediate shaft 7 and another drive means 13. In this manner, the weft thread S is taken from spools 2 and delivered to a storage means 14.

This storage means 14 comprises a timing belt 15 which is laid over a driven timing belt pulley 16 and a non-driven timing belt pulley 17. Carriage 18 is mounted on belt 15 and supports a reversal point 19. This reversal point 19 oscillates in the direction of arrow P1 to deflect threads S. In this particular example, point 19 comprises a free standing round rod with a friction-free outer surface.

Downstream, a second delivery means 20 has two rollers 21 and 22, which are connected to each other by gear wheel pair 64. They are driven with a varying thread drive speed.

The drive of the storage means 14 and the second delivery means 20 proceeds in the following manner: An intermediate shaft 23 is driven by the main shaft 6 over the intermediate shaft 7 and also by another drive means 24, shown as a belt drive.

A planetary interference drive 27 is shown as a planetary wheel 26 having external teeth and containing a gear train mounted inside of casing 26 to affect the rotation of gears 38 and 40. Specifically positive rotation of gear 38 tends to cause positive rotation of gear 40, but positive rotation of wheel 26 tends to cause negative rotation of gear 40. By means of belt drive 25, the planetary wheel 26 of interference drive 27 is turned by a number of revolutions proportional to the rate of revolution of the main shaft.

Simultaneously, intermediate shaft 23 drives a camplate 30 mounted about axle 29 in cyclic drive 28. Cam followers 31 follow camplate 30 and are mounted on output belt 32, that is laid around two rollers 33 and 34. This output belt is oscillates in the direction of arrow P2. This movement is transferred via roller 34, belt drive 35 and intermediate shaft 36: (a) to interference input 38 of interference drive 27, and (b) storage means 14 via a transmission means comprising change gears 89 which drive the timing belt pulley wheel 16. In this manner, deflecting point 19 oscillates in the direction of arrow P1. Furthermore, the continuous rotation of the interference wheel 26 by the belt drive 25 is altered by the oscillation of gear 38 so that a transmission means comprising change gears 40 on the output side produce a variable drive speed for the second delivery means 20.

The weft threads S eventually arrive at thread guides 41 on carriage 42, which is movable in the direction of arrow P3 on rails 44. Also this drive movement is taken off from the main drive shaft 6 of the warp knitting machine in the conventionally known manner. By this back and forth movement, the weft threads S are placed as magazine weft threads in front of the hooks of two carrier chains 45 and 46, which feed those magazine weft threads (in a direction perpendicularly to the plane of the drawing), to the warp knitting machine.

FIG. 5 illustrates the thread take-up, more precisely. The deflecting point 119 is shown as an undriven, mounted an friction free bearings roller. The thread guide is shown in 3 positions, namely, 41*l* (left), 41*m* (middle) and 41*r* (right). In the laying movement from the left up to the machine mid-point, the sector B1 is laid as sector A1 and the sector C1 as sector C2. The sector C3 therefore represents the actual utilization of weft thread, as seen from delivery means 20. If the carriage is then moved further to the right from the mid-point, sector C3 corresponds in length to sector C4 and sector D1 to D2. The actual use in this movement is thus the sum of sectors A2 and B2. This gives rise to a take-off speed dependent upon the position of the carriage 42. In accordance with the invention, the thread drive speed of the second delivery means 20, is equal or proportional to the take-off speed at that moment.

The diagram of FIG. 6 shows the amount of thread length L forwarded over time t. Curve I shows the forwarded length of the first delivery means which, because of its coupling with the main shaft, has a constant delivery speed. The curve 120 shows the thread drive speed of the second delivery means 20. This takes in to account the small thread speed in the first half of the path movement of the carriage 42, and the large thread speed in the second half. The vertical difference "d" between curves 19 and 120 corresponds to the thread length which must be taken up by the storage means 114.

Furthermore, it is possible to run the first delivery means 9 at the same circumferential speed as the spool 2. The weft threads S thus are subject to no tension whatsoever in the creel 1. The storage means 14 is set exactly to the difference "d". The weft threads thus experience no tension between the two delivery arrangements. Since the thread drive speed of the second delivery means 20 is the same as the actual take-off speed, the threads are untensioned, even in the last segment. Since no unacceptable thread tensions will occur, the resulting ware is very even. Significantly, with elastic weft threads, there is no crimping of the ware after the production of the goods.

It is also possible, if desired, to knit the elastic weft threads with a constant pre-tension. In order to achieve this, an extension of the threads must occur in at least: one segment before the first delivery means 9; after the second delivery means 20; or between the two delivery means, preferably in the first named segment. This can be achieved by a proportional change of the drive speed. Thus, a transmission means comprising change gears 47 in the drive path of the friction rollers 5 reduce the drive speed of the spools. As a result thereof, the weft threads are already extended, even before reaching the first delivery means 9, so that they may be utilized in a condition of pretension. By means of a similar pair of change gears, it is possible to alter the drive speed of the first delivery means 9.

By utilizing change gear pair 39, it is possible to alter the drive speed of the storage means 14 and by using change gear pair 40, the drive speed of the second delivery means 20. Notwithstanding the resulting changes of tension, the cyclic drive 28 is unchanged.

Figure 7:
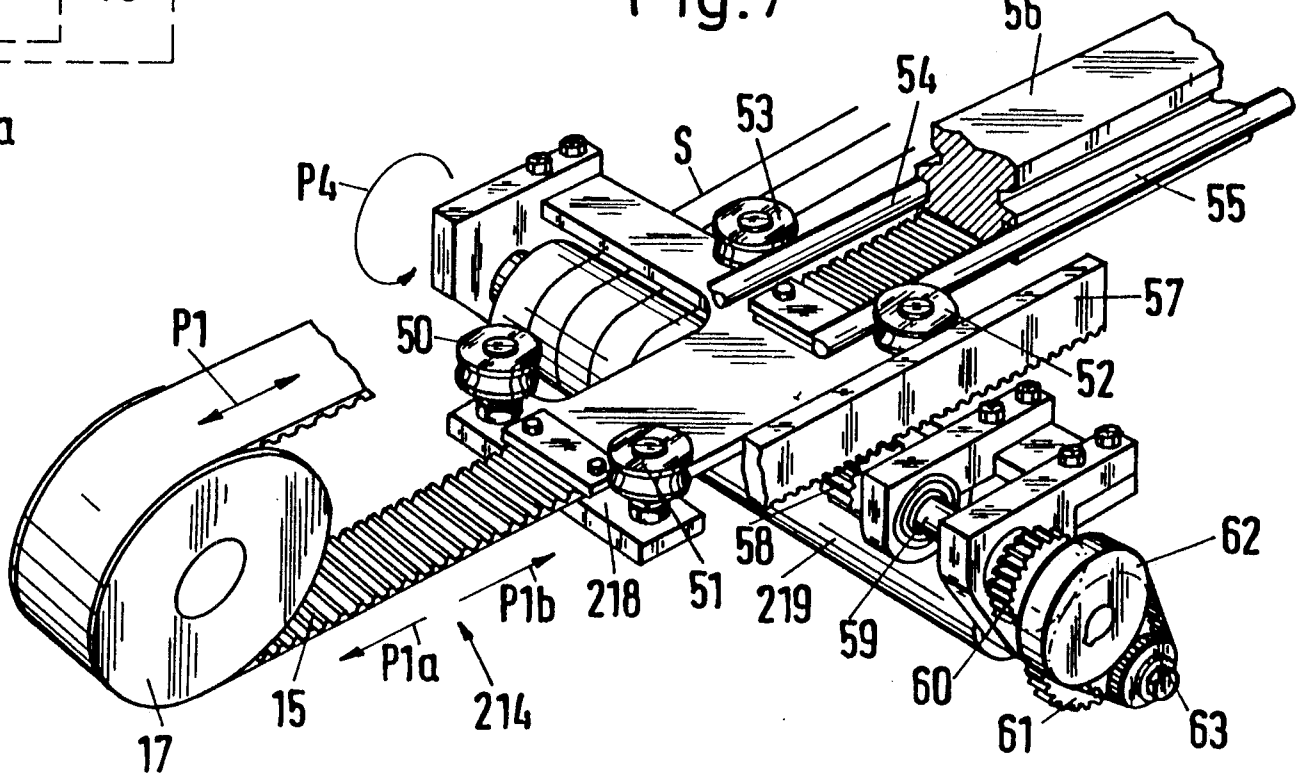
FIG. 7 is a partial, downward perspective view of the components of the storage arrangement as viewed from the left in FIG. 3.

In the storage means 214 as illustrated in FIG. 7, the deflection point 219 is formed by means of a driven reversing roller coupled to and driven by a controlled motor for reversing the direction of said weft threads. The carriage 218 is a plate rotatably supporting a plurality of guide rollers 50 through 53. These rollers roll on guide rails 54 and 55, mounted on a guiding ledge 56. Rack 57 running the length of the predetermined course is stationary in the frame. It meshes with a pinion 58 whose pinion shaft 59 is connected with the shaft of the reversal roller 219 by means of two drive branches one of said branches being operable to accelerate the reversing roller the other one of said branches being operable to decelerate the reversing roller. One of the drive branches is formed by meshed gear wheels 60 and 61. The other branch is formed by two mutually connected timing belt pulleys 62 and 63. The wheels 61 and 62 which ride on a turning shaft, are each equipped to free-wheel, although free wheeling can occur in their complementary wheels instead. The gear wheels 60 and 61 operate at a decelerated speed and the pulleys 62 and 63 at an accelerated speed.

The timing belts 15 as shown in FIG. 1, cause the back and forth motion P1. When, for purposes of storage, the movement direction of P1*a* predominates (as illustrated in FIG. 7), the gear pairs 60 and 61 are operative which leads to a rotation of the reversal roller 219 in the direction P4. When, in contrast thereto, the movement direction P1*b* predominates for delivering stored thread, drive occurs over the timing belt pulleys 62 and 63 which, in turn, again leads to a rotation of the turning means 219 in the direction P4, but at a greater speed. Thus the rotational velocity in the storage mode is smaller than the rotational velocity in the thread delivery mode. The transmission ratios of the gear wheels 60 and 61 and the timing belt pulleys 62 and 63 are so chosen that by the interference of the rotation and the translation speeds, roller 219 matches the delivery speed of the first delivery means. This means that there is practically no relative movement between the weft threads and the reversing roller 219 and correspondingly, no friction which can lead to a tension peak.

Figure 8:
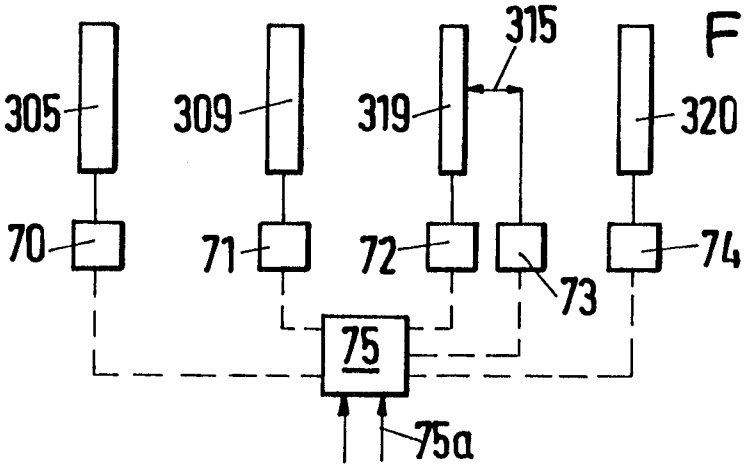
FIG. 8 is a further embodiment in schematic form.

In FIG. 8, the numbering of items corresponding to previously illustrated items is incremented by 300. In this mode, friction rollers 305 have their own drive 70 for driving spools 2. Delivery means 309, comprising only a single roller, has its own drive 71. The deflection point 319, which is constructed in the form of a driven roller, has its own drive means 72. The back and forth motion of the timing belt 315 is activated by drive 73. The second delivery means 320 is served by its own drive 74.

The drives 70 to 74 may be electrical motors, hydraulic motors or servo motors. They can drive equipment that is the same as just described except for the inclusion of a different drive. All of the individual drives 70 through 74 are controlled by computer 75, which is supplied with the tension requirement data via input means 75*a*. Input means 75*a* also includes a synchronizing signal indicating the phasing of the main shaft (shaft 6 of FIG. 1) or the carriage (carriage 42 of FIG. 1). This synchronizing signal is used to keep the above drive motors synchronized with the main shaft and the carriage.

The illustrated embodiments can be carried out in many variations without departing from the basic idea of the invention. Thus, for example, interference drive 27 instead of being a planetary drive, can also be bevel gear differential drive. The second delivery means 20 can be placed in the middle over the path of the carriage 42. If desired, it can also be displaced from this central position.

In sum therefore, there follows the provision of threads, in particular extremely elastic threads, wherein the demand for different thread lengths depends upon the position of the carriage, so that the threads can be delivered to the hooks of the carrier chains 45 and 46 with the least possible pre-tension (where this is desired).

What is claimed is:

1. A weft thread transporter for a continuous, oscillating weft magazine in a wrap knitting machine driven by a main shaft, said machine having a pair of parallel weft carriers and consuming weft threads from a creel, said transporter being adapted to work with the weft threads when they are either elastic or non-elastic, comprising:

a carriage having thread guides for laying the weft threads across the parallel weft carriers with a cyclically varying laying speed depending upon the position of the carriage, said carriage being operable to lay the weft threads by reciprocating between the parallel weft carriers of the magazine;

a first driven delivery means for providing the weft threads from said creel at a substantially constant delivery speed;

a second driven delivery means downstream from said first delivery means for delivering therefrom said weft threads at a variable thread drive speed that corresponds to the cyclically varying laying speed; and a storage means located between said first and second delivery means for compensating for the difference between the constant delivery speed and the variable thread drive speed.

2. A weft thread transporter in accordance with claim 1, wherein at a given time point, the variable thread drive speed is instantaneously the same as the substantially constant delivery speed.

3. A weft thread transporter in accordance with claim 2, wherein the second delivery means comprises:

a drive motor for powering said second delivery means; and a computer having synchronizing means responsive to the position of said carriage, said computer being operable to control said drive motor in response to the position of said carriage.

4. A weft thread transporter in accordance with claim 1, further comprising:

cyclic drive means having a cyclic output cycling in correspondence with the position of the carriage; and an interference drive having a pair of interfering inputs, one driven by said main shaft and the other by said cyclic output, said interference drive having an interference output driving the second delivery means.

5. A weft thread transporter in accordance with claim 1, wherein the storage means includes a single deflecting surface for reversing the path of said weft threads, said deflecting surface being the only reversal locus for the weft threads in said storage means, said transporter comprising:

cyclic drive means for cyclically driving said deflecting surface in correspondence with the difference between the substantially constant delivery speed and the variable thread drive speed of said first and second delivery means, respectively.

6. A weft thread transporter in accordance with claim 4, wherein said cyclic drive means is coupled to said storage means to drive it.

7. A weft thread transporter in accordance with claim 6, wherein the cyclic drive means comprises:

a camplate driven by the main shaft of the warp knitting machine; and an output element reciprocatingly driven by said camplate.

8. A weft thread transporter in accordance with claim 7, wherein the storage means includes a deflecting surface for reversing the path of said weft threads, the deflecting surface being reciprocatable along a straight course.

9. A weft thread transporter in accordance with claim 8, wherein the storage means comprises:

a reciprocatable carrier for carrying said deflecting surface; and an endless pulling means driven by the cyclic drive means for reciprocating said reciprocatable carrier.

10. A weft thread transporter in accordance with claim 9, wherein the endless pulling means comprises:

a driven timing pulley; and an endless timing belt circulating over said timing pulley.

11. A weft thread transporter in accordance with claim 10, wherein the deflecting surface of the storage means comprises a reversing roller driven at varying speed.

12. A weft thread transporter in accordance with claim 11, wherein said storage means comprises:

a rack running the length of the straight course;

a pinion rotatably mounted on said reciprocatable carrier for engaging said rack;

a pair of drive branches coupled to and driven by said pinion for alternately driving the reversing roller, each of said branches being operable to free wheel alternately depending upon the direction of rotation of said pinion, so that said reversing roller rotates in the same direction even as said pinion reverses its direction of rotation.

13. A weft thread transporter in accordance with claim 12, wherein one of said pair of drive branches comprises two spur gears, the other one of the drive branches comprising two interconnected timing belt pulleys, said spur gears and said timing belt pulleys being coupled in parallel between said pinion and said reversing roller, one of said branches being operable to accelerate the reversing roller, the other one of said branches being operable to decelerate the reversing roller.

14. A weft thread transporter in accordance with claim 11, wherein the storage means includes:

a controlled motor;

a reversing roller coupled to and driven by said controlled motor for reversing the direction of said weft threads; and a computer programmed to regulate the speed of said controlled motor.

15. A weft thread transporter in accordance with claim 1, wherein the storage means comprises:

an undriven reversing roller adapted to reverse the direction of said weft threads; and friction-free bearings rotatably supporting said reversing roller.

16. A weft thread transporter in accordance with claim 1, wherein the storage means comprises:

a non-rotating round rod having a friction free outer surface adapted to reverse the direction of said weft threads.

17. A weft thread transporter in accordance with claim 1, wherein the first delivery means comprises only a driven roll.

18. A weft thread transporter in accordance with claim 1, wherein at least one of (a) the second delivery means, (b) the first delivery means, (c) the storage means, and (d) the creel includes:

a transmission to change its operating speed.

19. A weft thread transporter in accordance with claim 5, wherein the deflecting surface of the storage means comprises a reversing roller driven at varying speed.

20. A weft thread transporter in accordance with claim 1, wherein the storage means includes:

a reciprocatable carrier having a reversing roller for reversing the path of said weft threads, said reciprocatable carrier being reciprocatable along a predetermined course;

a rack running the length of the predetermined course;

a pinion rotatably mounted on said reciprocatable carrier for engaging said rack;

a pair of drive branches coupled to and driven by said pinion for alternately driving the reversing roller, each of said branches being operable to free wheel alternately depending upon the direction of rotation of said pinion, so that said reversing roller rotates in the same direction even as said pinion reverses its direction of rotation.

21. A weft thread transporter in accordance with claim 1, wherein the storage means includes:

a controlled motor;

a reversing roller coupled to and driven by said controlled motor for reversing the path of said weft threads; and a computer programmed to regulate the speed of said controlled motor.

* * * * *